US005613247A

United States Patent [19]

Bowman

[11] Patent Number: 5,613,247

[45] Date of Patent: Mar. 25, 1997

[54] FIREFIGHTER'S GARMENT WITH THREAD PROTECTOR

[75] Inventor: J. Robert Bowman, Hookset, N.H.

[73] Assignee: Globe Manufacturing Company, Pittsfield, N.H.

[21] Appl. No.: 390,578

[22] Filed: Feb. 17, 1995

[51] Int. Cl.[6] ..... A41D 13/00

[52] U.S. Cl. ..... 2/81; 2/244; 2/274; 2/275; 112/418

[58] Field of Search ..... 2/69, 81, 244, 2/274, 275; 112/418; 428/920, 921

[56] References Cited

U.S. PATENT DOCUMENTS

| | | | |
|---|---|---|---|
| 2,135,727 | 11/1938 | Neuman | 112/418 |
| 2,336,833 | 2/1943 | Gugen | 112/418 |
| 2,702,387 | 2/1955 | Wenzel | 112/418 |

*Primary Examiner*—Diana Biefeld
*Attorney, Agent, or Firm*—Watson Cole Stevens Davis

[57] ABSTRACT

A piece of trim having a hard finish is disposed adjacent the outer surface of the outer shell which is formed of fire retardant material. A thread protector is disposed adjacent the outer surface of the trim, and a thread forming a line of stitching extends through the thread protector, trim and shell to hold the trim in place. The thread includes exposed portions, and the thread protector is formed of soft material and extends away from opposite sides of the exposed portions of the thread. The thread protector also is spaced from the outer surface of the trim a greater distance than the tops of the exposed portions of the thread so that if an object approaches the sides of the exposed portions, it will first contact an edge of the thread protector and cause the thread protector to fold over the exposed portions of the thread to prevent abrasion thereof.

6 Claims, 2 Drawing Sheets

FIREFIGHTER'S GARMENT WITH THREAD PROTECTOR

BACKGROUND OF THE INVENTION

The present invention relates to firefighter's garments such as coats and trousers, and more particularly to such garments having pieces of trim attached thereto for safety reasons. The pieces of trim are usually made of plastic material or plastic material impregnated with glass beads or microprisms so as to provide outer surfaces which are fluorescent and retroflective. These outer surfaces have a hard finish which causes significant problems over the life of the garments.

The pieces of trim are stitched to the conventional outer shell of the garment which is made of fire retardant material. The stitching has exposed portions disposed adjacent the outer surface of the pieces of trim. A first problem with this construction is the fact that the exposed portions of the thread cannot sink any substantial distance into the outer surface of the trim because of the hard finish on such outer surface. Therefore, the exposed portions of the thread can be readily engaged by objects such as arm or leg portions of the garment which rub over the trim and the exposed portions of the thread thereby tending to abrade the thread and eventually causing it to break. As a result of such abrasion, trim on firefighter's garments often peel away from the associated garment and eventually fall off of the garment.

A second problem with the aforementioned construction is the caused by the fact that the plastic material of the trim gets brittle when it is subjected to a cold environment, and the trim tends to fracture or break at the stitch holes. The stitching can actually cut the trim material in prior art constructions, which of course is undesirable.

SUMMARY OF THE INVENTION

The present invention incorporates a novel construction wherein a line of stitching is provided for holding the trim in place on the outer surface of the outer shell of the garment. A thread protector is disposed between the outer surface of the trim and exposed portions of the thread.

The thread protector is in the form of an elongated strip of soft material having opposite edges which are disposed a substantial distance from opposite sides of the exposed portions of the thread so that when an object approaches the exposed portions in a direction to otherwise cause abrading action on the exposed portions of the thread, the thread protector can engage an object and fold over to protect the exposed portions of the thread. The upper portions of the opposite edges of the thread protector are spaced from the outer surface of the trim a greater distance than the tops of the exposed portions of the thread are spaced from the outer surface of the trim to ensure that an object will engage the thread protector before it engages the exposed portions of the thread.

The soft material of the thread protector enables the exposed portions of the thread to sink into the outer surface of the thread protector so that a substantial portion of the outer surface of the thread is embedded in the material of the thread protector and thereby completely protected from abrasion. Of course, when the edges of the thread protector fold over and cover the exposed portions of the thread, the exposed portions of the thread are also completely protected from abrasion. Additionally, when the trim is cold and brittle, the soft material of the thread protector reduces the tendency of the thread to cut the trim material since there is no direct contact between the exposed portions of the thread and the outer surface of the trim.

DESCRIPTION OF THE PREFERRED EMBODIMENT

Figure 1:
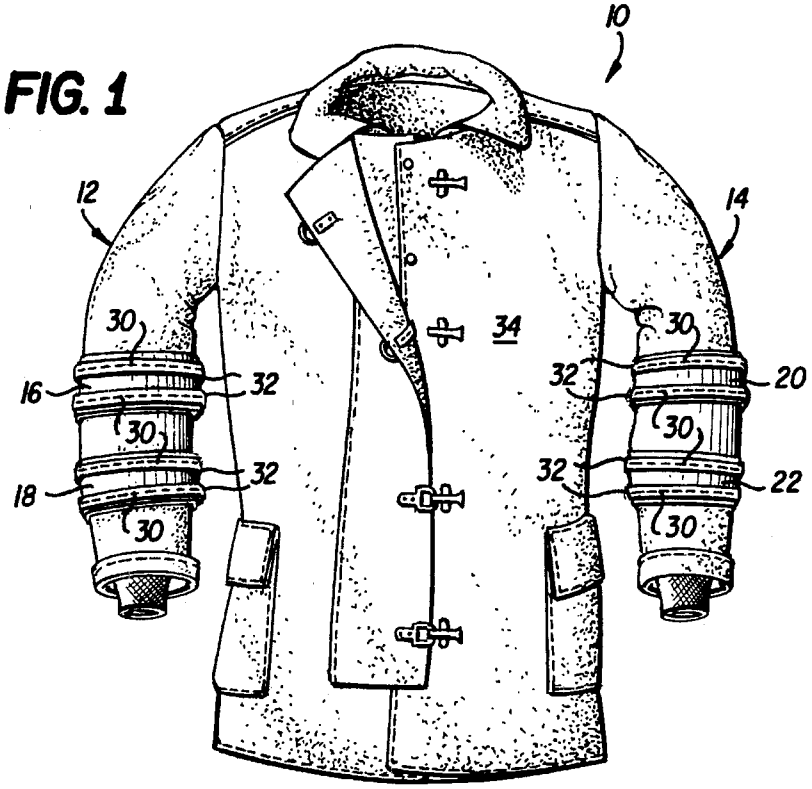
FIG. 1 is an elevation of a conventional firefighter coat having trim thereon.

Referring to the drawings wherein like reference characters designate corresponding parts throughout the several views, there is shown in FIG. 1 a conventional firefighter coat 10 having arms 12 and 14. Arm 12 has two spaced strips of trim 16 and 18 extending therearound, and arm 14 has two spaced strips of trim 20 and 22 disposed therearound. It should be understood that additional pieces of trim may be supported on the coat such as a strip around the torso portion 34 of the coat. All of the strips are attached to the associated sleeve by similar lines of stitching 30, each of the lines of stitching having a thread protector 32 associated therewith. Except in the case of four row stitching, only the two outside will use the thread protector material. Each thread protector comprises an elongated strip of knitted soft material such as a combination of rayon and nylon which has been treated to be fire retardant. The material may also be the same material as the outer shell, but this construction would be more expensive. The strip may be of any suitable soft material having the desired characteristics.

Figure 2:
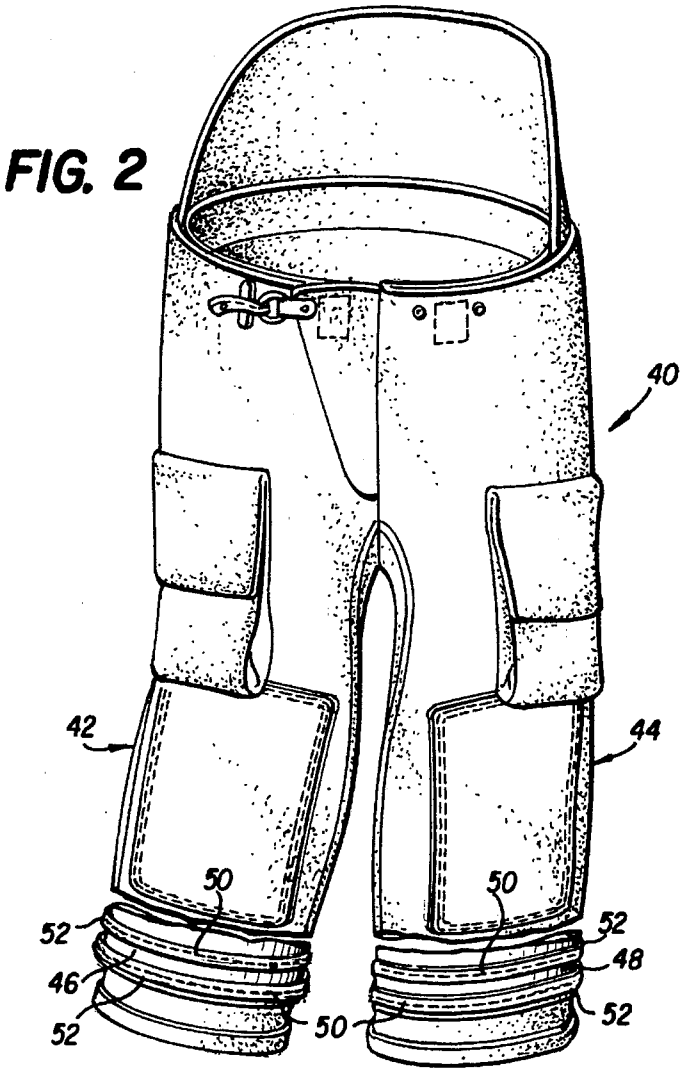
FIG. 2 is a an elevation of conventional firefighter trousers having trim thereon.

FIG. 2 shows conventional firefighter trousers including a pair of legs 42 and 44 which have strips of trim 46 and 48 extending therearound respectively. Each of the strips is attached to the associated leg by similar lines of stitching 50, each of the lines of stitching having a thread protector 52 associated therewith. Except in the case of four row stitching, only the two outside will use the thread protector material.

Figure 3:
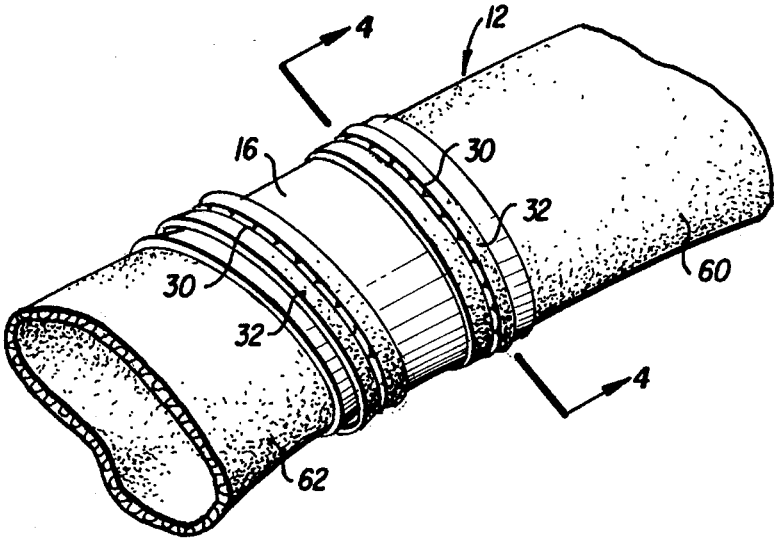
FIG. 3 is an enlarged broken-away perspective view of a portion of a sleeve of the garment shown in FIG. 1.
Figure 4:
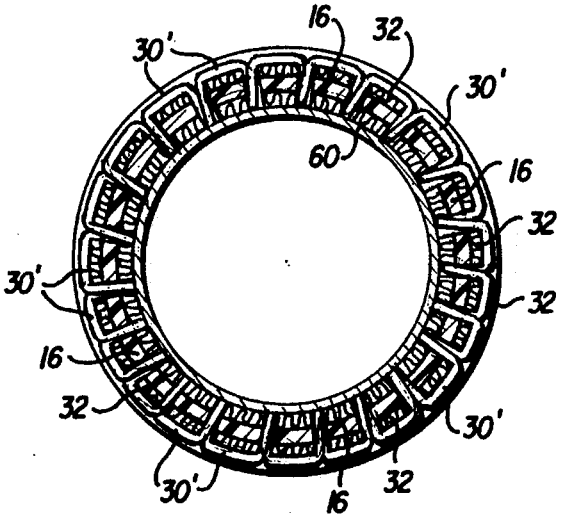
FIG. 4 is a sectional view taken along line 4—4 of FIG. 3.

Referring to FIGS. 3 and 4, a portion of sleeve 12 is shown upon which the piece of trim 16 is supported. It should be understood that trim 16 may be in one piece or a plurality of pieces as desired. The sleeve includes an outer shell 60 formed of fire retardant material, a conventional liner 62 being disposed within the outer shell and suitably connected thereto in the usual manner. The piece of trim is attached to the outer shell by two generally parallel lines of stitching 30 each of which has a thread protector 32 associated therewith. The stitching includes exposed portions 30' which are disposed outwardly of the outer surface of the piece of trim with the thread protector disposed between the outer surface of the piece of trim and the exposed portions. It should be understood that the construction of the thread protector as described herein relates specifically to the sleeve of a coat, whereas similar constructions are employed at all portions of the firefighter garments where trim is supported.

Figure 6:
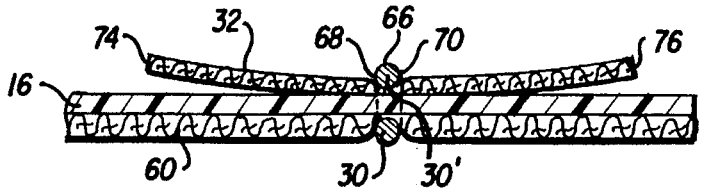
FIG. 6 is a sectional view taken along line 6—6 of FIG. 5.
Figure 5:
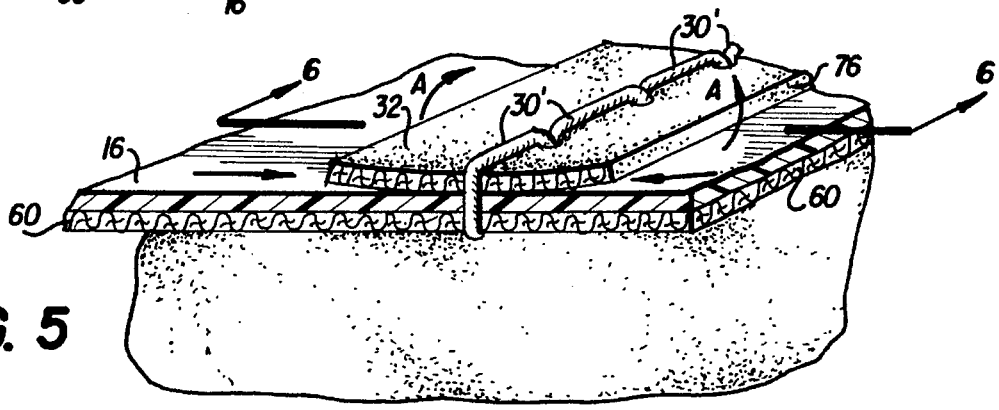
FIG. 5 is an enlarged perspective view of a cross-section through a part of the sleeve shown in FIG. 3.

As seen in FIG. 6, each of the exposed portions 30' has a top 66 and opposite sides 68 and 70. The thread protector 32 has opposite edges 74 and 76 extending longitudinally thereof. The opposite edges 74 and 76 include upper portions which are spaced from the outer surface of trim 16 a greater distance than the tops 66 of the exposed portions. As seen in FIGS. 5 and 6, the line of stitching extends substantially parallel with and midway between edges 74 and 76 which are generally parallel with one another. The opposite edges 74 and 76 of the thread protector are spaced a substantial distance from the associated sides 68 and 70 of exposed portions 30' so that the thread protector can fold over as indicated by arrows A in FIG. 5 to protect the exposed portions of the thread.

It is apparent that if an object approaches the sides of certain exposed portions in a direction to cause an abrading action on the certain exposed portions, the object will first contact one of the edges of the thread protector to cause the thread protector to fold over the certain exposed portions to protect such exposed portions from abrasion. The edges of the thread protector are adapted to fold over to a position such that the exposed portions of the thread are completely covered by the thread protector in those areas where the thread protector is folded over.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A firefighter's garment including an outer shell formed of fire retardant material and having an outer surface, a piece of trim adjacent the outer surface of said shell and having an outer surface with a hard finish, a thread protector adjacent the outer surface of said trim and having an outer surface, and a thread forming a line of stitching which extends through said thread protector, said trim and said shell to hold the trim in place on the outer surface of said shell, said thread including exposed portions adjacent the outer surface of said thread protector, each of said exposed portions having a top and opposite sides, said thread protector being formed of soft material and extending away from the opposite sides of said exposed portions to protect said exposed portions of the thread.

2. A garment as defined in claim 1 wherein said thread protector includes opposite edges, said edges including upper portions spaced from the outer surface of said trim a greater distance than the tops of said exposed portions.

3. A garment as defined in claim 1 wherein said thread protector includes opposite substantially parallel edges, said line of stitching extending substantially parallel with said opposite edges and being disposed substantially midway therebetween.

4. A garment as defined in claim 1 wherein said thread protector includes opposite edges spaced a substantial distance from the the associated sides of said exposed portions so that the thread protector can fold over and protect said exposed portions.

5. A garment as defined in claim 1 wherein said thread protector includes opposite edges, said edges including upper portions spaced from the outer surface of said trim a greater distance than the tops of said exposed portions, said thread protector including opposite edges spaced a substantial distance from the associated sides of said exposed portions so that if an object approaches the sides of said exposed portions in a direction to cause an abrading action on the exposed portions, the object will first contact one of said edges of the thread protector to cause the thread protector to fold over said exposed portions to protect said certain exposed portions from abrasion.

6. A firefighter's garment including an outer shell formed of fire retardant material and having an outer surface, a piece of trim adjacent the outer surface of said shell and having an outer surface with a hard finish, a pair of spaced thread protectors adjacent the outer surface of said trim and having outer surfaces, and a pair of threads each forming a line of stitching through one of said thread protectors, said trim and said shell to hold the trim in place on the outer surface of said shell, said threads including exposed portions adjacent the outer surfaces of said thread protectors, each of said exposed portions having a top and opposite sides, said thread protectors being formed of soft material and each extending away from the opposite sides of the exposed portions of the associated thread to protect said exposed portions of the thread.

* * * * *